US005146989A

United States Patent [19]

Rouse

[11] Patent Number: 5,146,989

[45] Date of Patent: Sep. 15, 1992

[54] APPARATUS FOR RECOVERING A WELLHEAD

[75] Inventor: Geoffrey O. Rouse, Aberdeen, Scotland

[73] Assignee: Homco International Inc., Pearland, Tex.

[21] Appl. No.: 671,812

[22] PCT Filed: Aug. 2, 1990

[86] PCT No.: PCT/GB89/01203

§ 371 Date: Apr. 2, 1991

§ 102(e) Date: Apr. 2, 1991

[87] PCT Pub. No.: WO91/02138

PCT Pub. Date: Feb. 21, 1991

[30] Foreign Application Priority Data

Aug. 3, 1989 [GB] United Kingdom ..... 8917818
Aug. 9, 1989 [GB] United Kingdom ..... 8918198

[51] Int. Cl.[5] ..... E21B 33/02
[52] U.S. Cl. ..... 166/339
[58] Field of Search ..... 166/338, 339, 340, 351, 166/361, 368, 297, 75.1, 77.5

[56] References Cited

U.S. PATENT DOCUMENTS

| | | | |
|---|---|---|---|
| 3,325,190 | 6/1967 | Eckert et al. | 166/339 X |
| 3,513,911 | 5/1970 | Peterson | 166/338 |
| 3,589,441 | 6/1971 | Brown | 166/339 |
| 4,181,196 | 1/1980 | Darby et al. | 166/361 |

OTHER PUBLICATIONS

Brochure of TAM International, published on *Composite Catalogue,* 1980/81, p. 6740.

*Primary Examiner*—Thuy M. Bui
*Attorney, Agent, or Firm*—Arnold, White & Durkee

[57] ABSTRACT

The invention relates to an apparatus for recovering a wellhead. The apparatus includes a housing, a latch, and a latch device actuator which are responsive to a force applied to the apparatus to separate the apparatus from the wellhead, which force will then cause the latch device to engage an external, rather than internal, profile of the wellhead so that the apparatus remains in engagement with the wellhead. The apparatus also includes a shaft which is capable of carrying a cutting mechanism to facilitate severing of the wellhead.

9 Claims, 5 Drawing Sheets

26
20
11
10
9
3
19
3
4
4
8
2
11
7
50
27
16
6
5
15
4
16
18
17
3
11
5
3
1
2
2
26
17
20

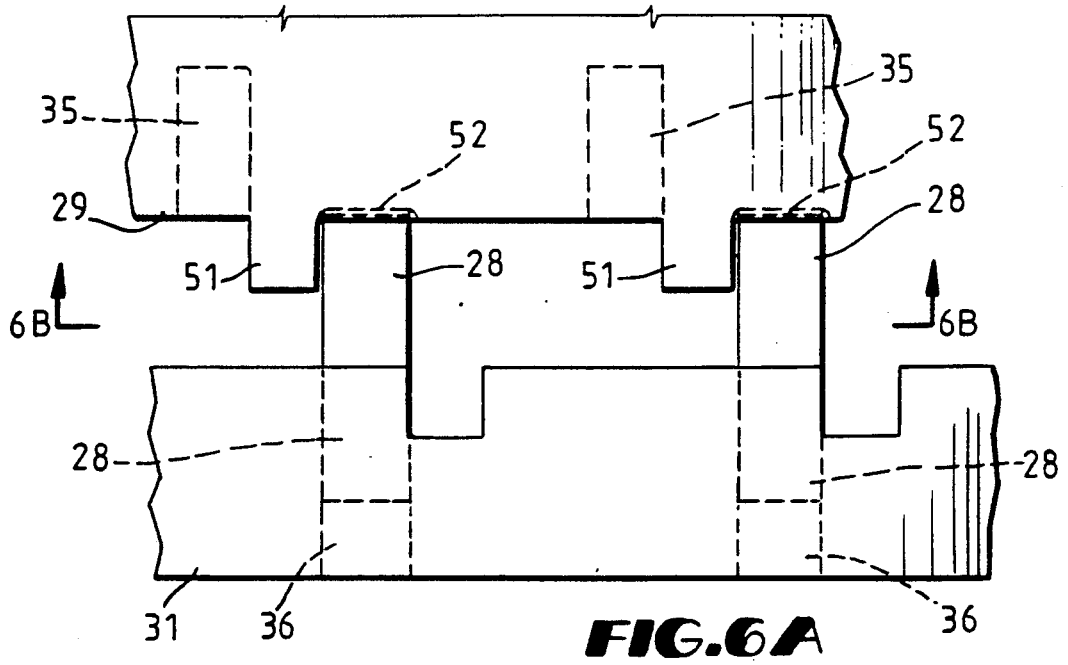
FIG.6A
FIG.6B
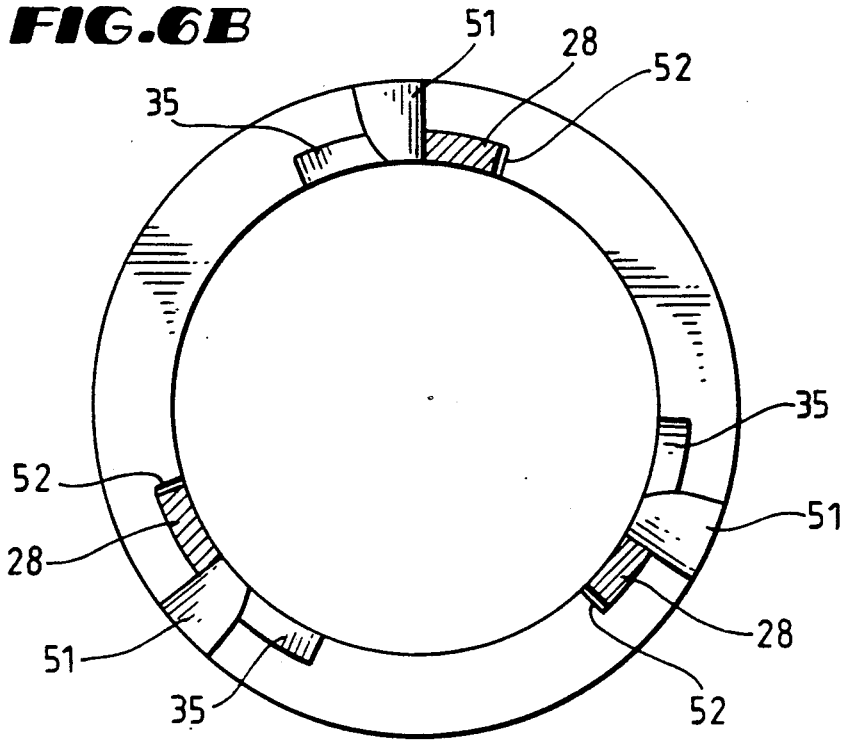

APPARATUS FOR RECOVERING A WELLHEAD

The invention relates to apparatus for recovering a wellhead.

In the offshore oil industry when a site is to be abandoned and the rig moved to a different location, the wellhead and at least nine feet (three meters) of the casing lying below the sea-bed must be removed.

Conventionally, apparatus for recovering wellheads has been designed to be inserted in&o the wellhead and casing and to lock on to internal threads on the inside of the wellhead. After the casing has been cut by a cutting mechanism located below the apparatus, the apparatus is used to retrieve the wellhead by pulling on the wellhead where the apparatus engages the wellhead internally.

One of the main disadvantages of this prior art apparatus is that it is believed to cause internal damage to the wellhead.

In accordance with the present invention, apparatus for recovering a wellhead comprises a housing; a latch device; and a latch device actuator, the apparatus being such that when a force is applied to the apparatus to separate the apparatus from the wellhead the actuator causes the latch device to engage an external profile of the wellhead so that the apparatus remains in engagement with the wellhead.

Preferably, the apparatus also comprises a shaft which extends through the housing and which is rotatable relative to the housing, the shaft being capable of carrying a cutting mechanism.

The invention avoids the problems and disadvantages of the prior art apparatus by enabling the apparatus to engage an external profile of a wellhead as opposed to engaging the wellhead internally.

Preferably the latch device comprises an engagement arm which is pivotable between a disengaged position in which the engagement arm is disengaged from the external profile of the wellhead and an engaged position in which the engagement arm engages the external profile of the wellhead. Typically, the latch device also comprises biassing means to bias the engagement arm to the disengaged position.

In the preferred embodiment, the actuator comprises a square shoulder which co-operates with the engagement arm when actuated to pivot the arm, against the action of the biassing means, to the engaged position. Alternatively, the actuator could comprise a slip mandrel instead of a square shoulder.

Preferably, the cutting mechanism attached to the shaft is a conventional radially acting cutter. In one example of the invention the cutter is operated while force is being applied to the apparatus to pull the wellhead away from the well, i.e. the wellhead is cut in "tension". However, in a second example the cutter is operated while a force is applied to the apparatus to push the apparatus on to the wellhead, i.e. the wellhead is cut in "compression".

In the preferred embodiment, the apparatus also comprises a disengagement device to prevent actuation of the latch device actuator and to enable the apparatus to be pulled off the wellhead if the pulling force applied to the apparatus is not sufficient to remove the wellhead. In one example, the disengagement device comprises a "J" lock which may be engaged to prevent actuation of the actuator in order to enable a force to be applied to the apparatus in a direction away from the wellhead which does not activate the actuator. In a second example the disengagement device comprises a latch and a co-operating recess which may be misaligned to prevent actuation of the actuator.

In one example, the cutting mechanism is used in conjunction with a conventional marine swivel attached to the shaft to enable the shaft to rotate within the housing while the latch device remains stationary with respect to the wellhead. In a second example the apparatus comprises bearings to enable the shaft to be rotated within the housing while the latch device remains stationary with respect to the wellhead.

Two examples of apparatus for recovering a wellhead in accordance with the invention will now be described with reference to the accompanying drawings, in which:

FIG. 6A is a detailed schematic view of an engagement and disengagement mechanism for use in the apparatus shown in FIG. 5;

FIG. 6B is a view along the line B—B in FIG. 6A; and,

Figure 1:
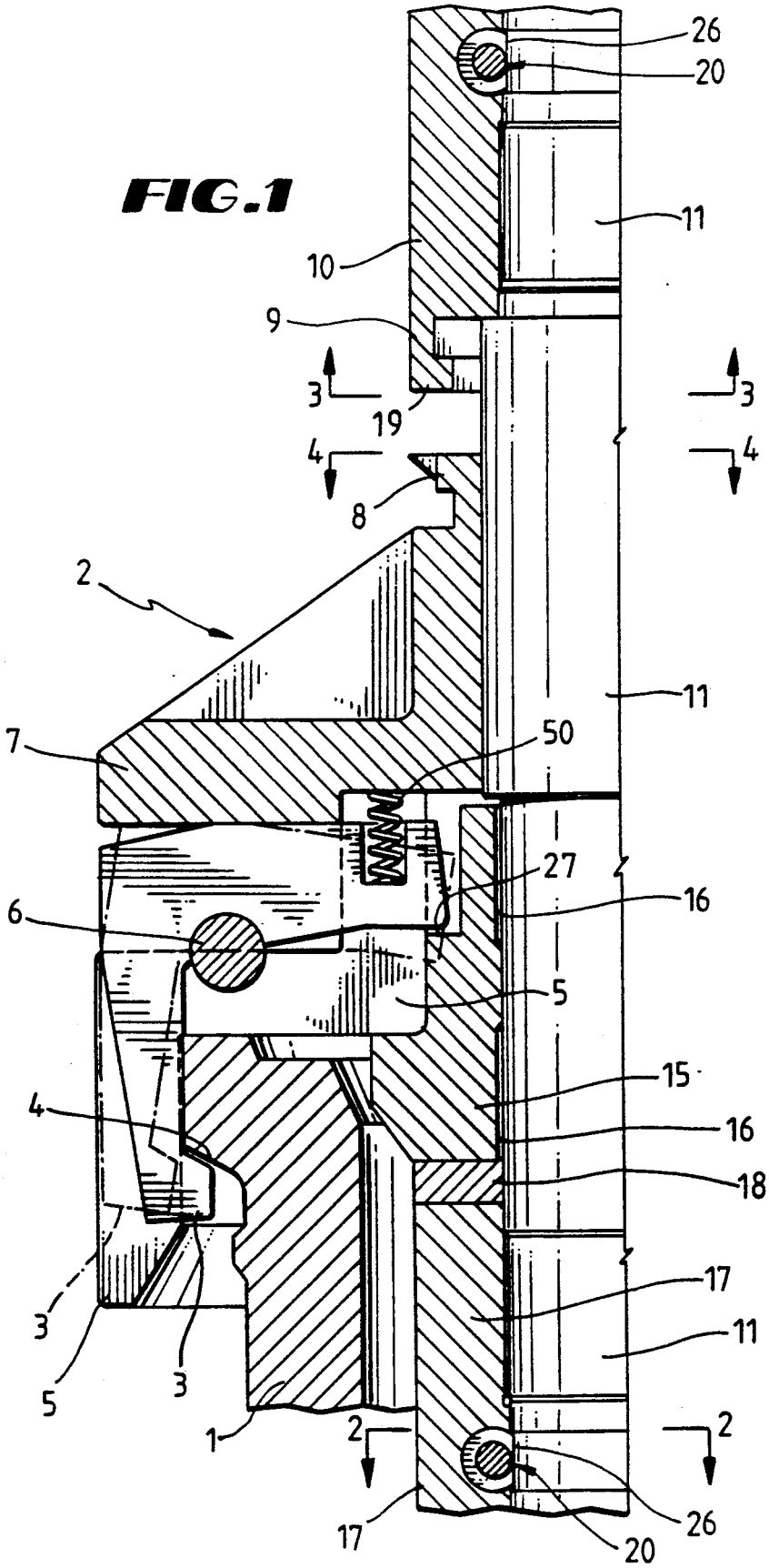
FIG. 1 is a partial cross-sectional view of a first example of apparatus to remove a wellhead.

FIG. 1 shows a wellhead 1 and a wellhead removal tool 2 which is attached to the wellhead 1 by means of three engagement arms 3 (only one of which is shown). The engagement arm 3 attaches on to an external profile 4 of the wellhead 1.

The engagement arms 3 are mounted in a protective skirt 5 by means of a pivot 6. The pivot 6 enables the engagement arm 3 to pivot from an engaged position where it engages the wellhead 1 to a disengaged position, shown in phantom in FIG. 1. The engagement arm 3 is biased towards the disengaged position by means of a helical spring 50.

Mounted on top of the protective skirt 5 and above the engagement arm 3 there is an upper housing 7. The skirt 5 is bolted to the upper housing 7 and separated from the upper housing by a number of spacers (not shown) located circumferentially around the tool 2 between adjacent arms 3. At the top end of the upper housing 7 is a male section 8 of a "J"-type releasable connector. A corresponding female section 9 of the releasable connector forms part of an upper shaft housing 10.

Figure 3:
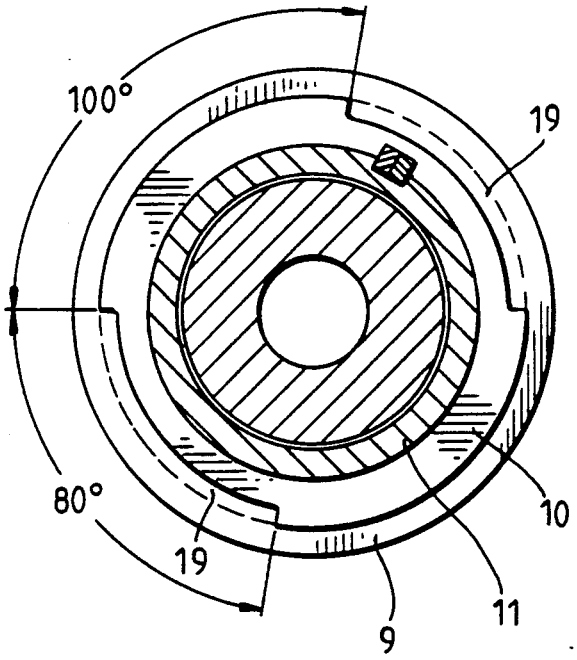
FIG. 3 is a cross-sectional view along the line Y—Y in FIG. 1.

As can be seen from FIG. 3, the female section 9 of the releasable connector has two female co-operating sections 19 which co-operate with two male co-operating sections 12 (see FIG. 4) to releasably connect the upper shaft housing 10 to the upper housing 7. The male co-operating sections 12 each comprise a shoulder 13 and an entrance 14. The shoulder 13 limits the relative rotational movement between the female co-operating sections 19 and the male co-operating sections 12 after the female co-operating sections 19 have been inserted into the entrances 14 in the male sections 12.

Figure 4:
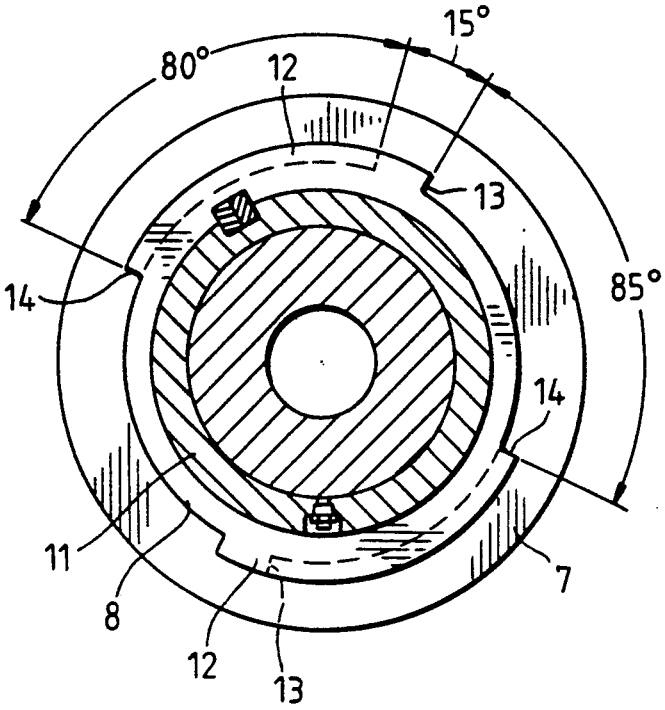
FIG. 4 is a cross-sectional view along the line X—X in FIG. 1.

As can be seen from FIG. 3 each of the female co-operating members 19 are situated diametrically opposite each other and are separated by angles of 100 degrees so that each female co-operating section 19 subtends an angle of 80 degrees. Similarly, as shown in FIG. 4, the male co-operating sections 12 are situated diametrically opposite each other and are separated by an angle of 85 degrees so that each male co-operating section 12 subtends an angle of 95 degrees. The angle subtended by each male co-operating section 12 from the entrance end 14 to the lock shoulder 13 is 80 degrees. Hence, when the male section 8 is fully locked to the female section 9, the female co-operating sections 19 completely overlap the male co-operating sections 12 and are located between the entrance 14 and the lock shoulder 13.

Mounted on the shaft 11 is a square shoulder 15 which is mounted on the shaft 11 by means of the bearings 16. The bearings 16 may be bronze bearings or alternatively, radial glazier bearings. The square shoulder 15 is attached to a lower shaft housing 17 by means of a set of bronze thrust bearings 18. The bronze thrust bearings 18 and the bearings 16 enable the lower shaft housing 17 and the shaft 11 to be rotated relative to the square shoulder 15 so that the square shoulder 15 remains stationary with respect to the engagement arm 3, the protective skirt 5 and the upper housing 7, when the upper housing 7 is not connected to the upper shaft housing 10 by means of the releasable connector.

The upper shaft housing 10 and the lower shaft housing 17 are connected to the shaft 11 by means of double securing anti-backoff cotter devices 20. The device 20 connecting the lower shaft housing 17 to the shaft 11 is shown in more detail in FIG. 2, where it can be seen that the cotter device 20 comprises two sections 21, 22 and a securing pin 30 which are located in a through bore 23 in the lower shaft housing 17. The section 21 has a threaded pin section 24 which fits into a square threaded hole 25 in the section 22. To double secure the sections 22, 21 together the securing pin 30 also connects the sections 20, 21.

Figure 2:
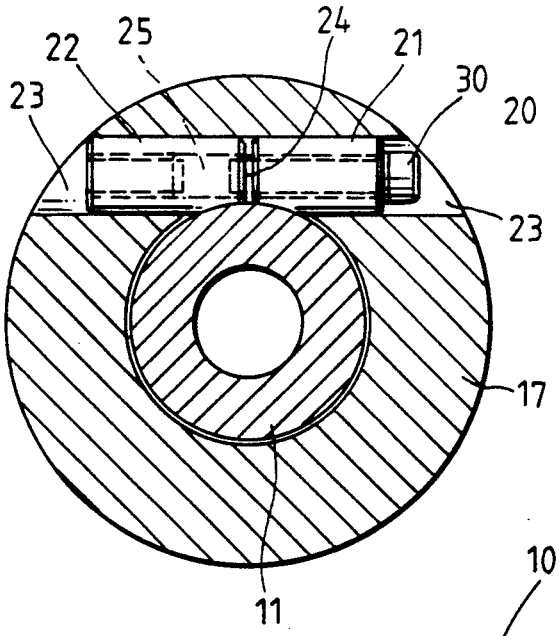
FIG. 2 is a cross-sectional view along the line A—A in FIG. 1.

As shown in FIG. 1 and FIG. 2 each cotter device 20 engages a recess 26 formed in the shaft 11. This ensures that the shaft housings 10, 17, rotate with the shaft 11 when the shaft 11 is rotated. As the cotter device is double secured, there is very little likelihood of either of the shaft housings 10, 17 becoming disengaged from the shaft 11.

In use, the upper shaft housing 10 is connected to the upper housing 7 by means of the male and female releasable connector sections 8, 9. The wellhead removal tool 2 is then lowered on to a wellhead 1 so that the lower housing 17 and the shaft 11 enter the centre of the wellhead 1 and so that the protective skirt 5 encircles the top of the wellhead 1 and the engagement arms 3 which are biased to the disengages position by the springs 50, pass over the sides of the wellhead 1.

The shaft 11 is then rotated anti-clockwise through 80 degrees so that the female co-operating sections 19 disengage from the male co-operating sections 12. The shaft 11 is then tensioned upwards and this causes the upper shaft housing 10 to separate from the upper housing 7. This also draws the lower shaft housing 17 upwards which in turn pushes the square shoulder 15 up against a co-operating surface 27 of the engagement arm 3. This forces the engagement arm 3 to rotate about the pivot pin 6, against the biassing action of the spring 50, so that the engagement arm 3 engages with the external profile 4 of the wellhead 1. When this occurs the shaft 11 can be tensioned up to the required tension for cutting without the tool 2 separating from the wellhead 1.

When the required tension is reached the shaft 11 is rotated in order to operate a conventional cutter device (not shown) which is attached to the bottom of the shaft 11. The cutter device cuts a casing on which the wellhead 1 rests. When the cutter device has cut the casing rotation of the shaft 11 is stopped and the shaft 11 is tensioned further in order to pull the wellhead 1 away from the sea-bed and the cut casing by means of the engagement arms 3.

In some cases it is not possible to remove the wellhead 1 even after the cutter device has cut through the casing. In this case, it is necessary to be able to recover the tool 2 by disengaging it from the wellhead 1. This is accomplished by pushing the shaft 11 downwards so that the square shoulder 15 moves downwards and permits the spring 50 to pivot the engagement arm 3 to the disengaged position shown in phantom. The female section 9 and the male section 8 of the releasable connector are then re-engaged so that the upper shaft housing 10 is connected to the upper housing 7 of the tool 2. This enables the shaft 11 to be pulled upwards without the square shoulder 15 moving and causing the engagement arms 3 to move to the engagement position. Hence, the tool may be removed from the wellhead 1, if recovery of the wellhead is not possible.

Figure 5:
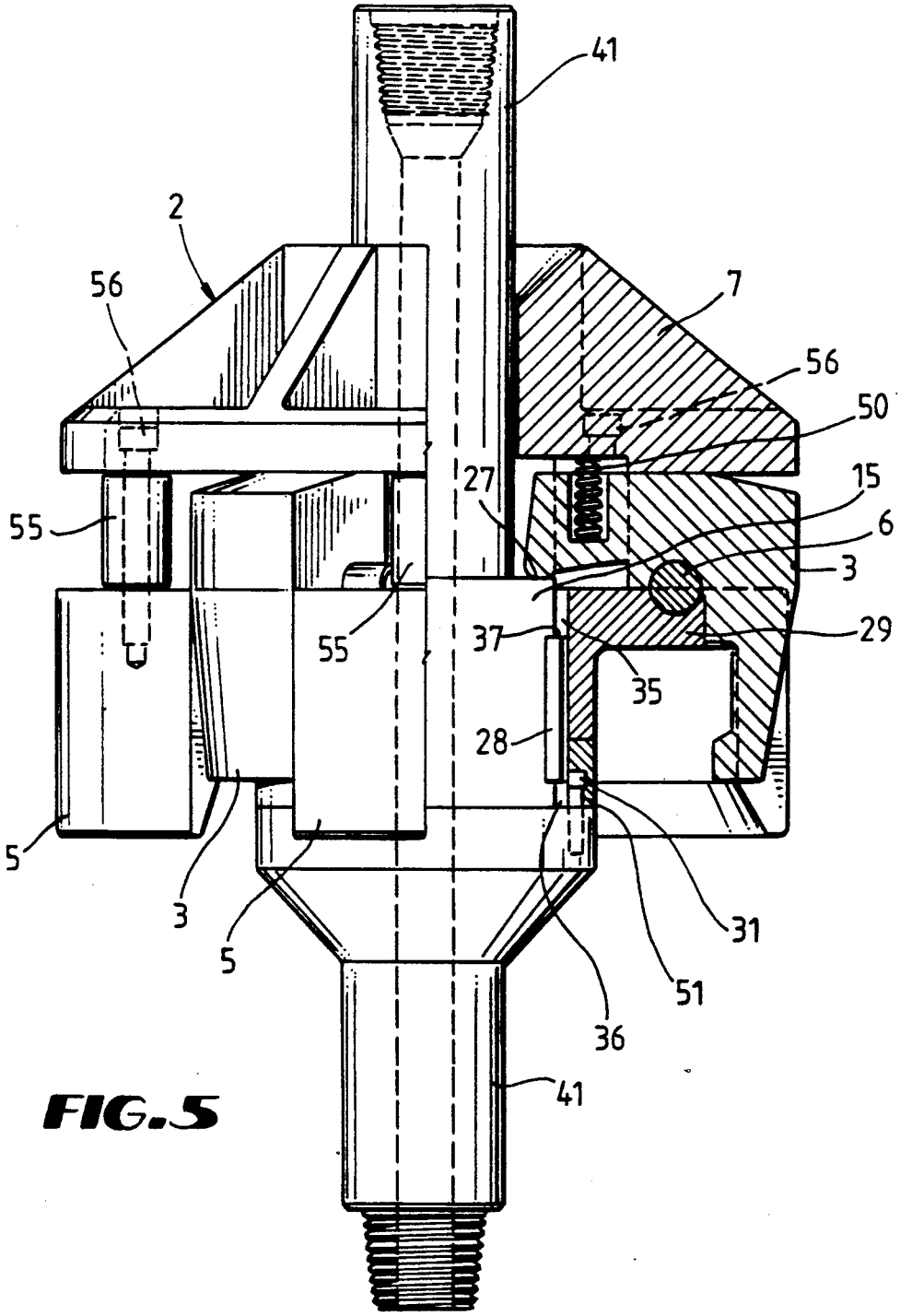
FIG. 5 is a partial cross-sectional view of a second example of apparatus to remove a wellhead.
Figure 7:
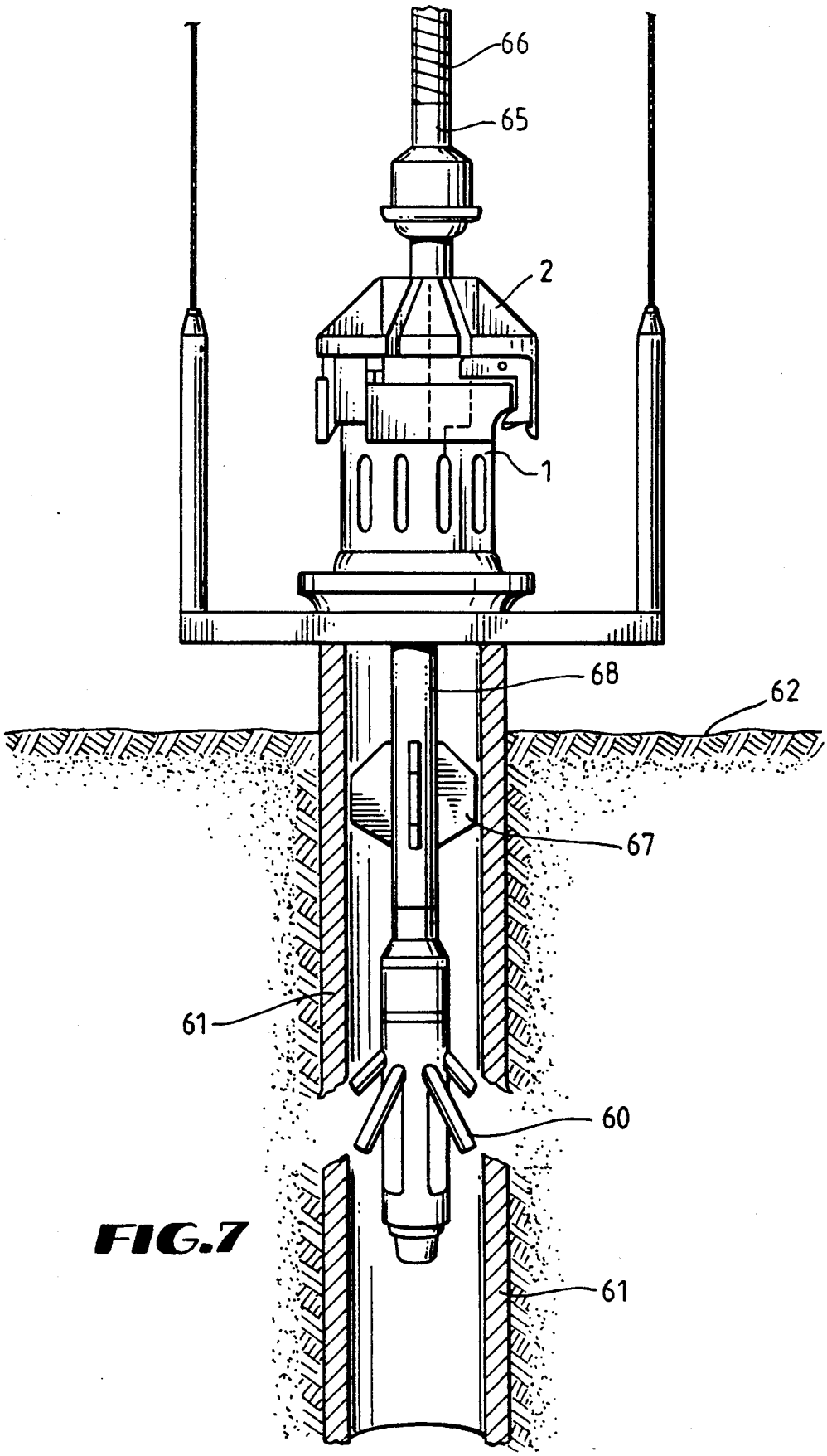
FIG. 7 is a schematic diagram showing the apparatus of FIG. 5 in use.

The apparatus shown in FIG. 5 is similar to the apparatus shown in FIG. 1 and identical reference numerals indicate equivalent parts of the apparatus. The main difference with the apparatus shown in FIG. 5 is that it is designed to cut the casing by operating in a compression mode, as opposed to a tension mode. In this example of the invention the square shoulder 15 forms part of an outer shaft 41. As shown in FIG. 7, a cutter 60 and a stabiliser 67 are attached to the lower end of an inner drive shaft 68 which is located coaxially within the shaft 41. The drive shaft 68 is rotated within the shaft 41 by means of a conventional marine swivel device 65 which is connected to a string 66 which extends upwards to a rig platform (not shown). The marine swivel device 65 co-operates with the upper end of the shaft 41 when the apparatus is compressed to enable the shaft 41 to remain stationary with respect to the engagement arms 3 while the inner drive shaft 68 rotates.

In addition, spacers 55 are shown in FIG. 5 which separate the skirt 5 from the upper housing 7 and through which bolts 56 pass to bolt the skirt 5 to the upper housing 7.

In order to facilitate engagement and disengagement of the square shoulder 15, three keys 28 are provided on the outside surface of the square shoulder 15 and co-operating slots 35, 36 are provided in a main body housing 29 and a thrust adapter 31 respectively of the tool 2 and this is shown in more detail in FIGS. 6A and 6B. The thrust adapter 31 is fixed to the shaft 41 and so the slots 36 in the thrust adapter 31 are always engaged with the respective keys 28. Rotation of the shaft 41 in an anti-clockwise direction causes the square shoulder 15 and hence the keys 28 to rotate so that they may be aligned with the respective slots 35 in the main body housing 29. When the keys 28 are aligned with the slots 35, the shaft 41 and the square shoulder 15 may be moved upwards to the position shown in FIG. 5, where the square shoulder 15 has pivoted the arms 3 to the engaged position adjacent the biassing action of the spring 50.

If the shaft 41 is then pushed downwards so that the top edge 37 of the keys 28 are below the lower edge of the main body housing 29, the shaft 41 and the square shoulder 15 can be rotated relative to the main body housing 29 to misalign the keys 28 with the slots 35 to prevent the square shoulder 15 moving up to activate the engagement arms 3. This enables removal of the tool from the wellhead. The main body housing 29 also has a lug 51 on its lower edge adjacent each slot 35. The lugs 51 provide a positive stop for alignment and misalignment of the keys 28 with the slots 35. In addition, there is also a recess 52 adjacent each lug 51 which co-operates with the top edge of each key 28 to help prevent the keys 28 being jarred into alignment with the slots 35 during lowering of the tool on to the wellhead 1. This would cause the square shoulder 15 to move up and pivot the arms to the engaged position prematurely. If this happened, the tool 2 would not engage the wellhead 1 properly.

In use, as shown in FIG. 7, the tool 2 is lowered on to a wellhead 1 and the drive shaft is compressed downwards so that the cutter 60 may be activated, via the marine swivel 65 which co-operates with the shaft 41 in order to cut the casing 61. After the casing has been cut by the cutter 60, rotation of the drive shaft is stopped and the shaft 41 is rotated in order to align the keys 28 with the slots 35, so that the square shoulder 15 may move upwards to pivot the engagement arms 3 to the engaged position. When this position has been achieved the upward tension on the shaft 41 can be increased as desired in order to pull the wellhead 1 away from the sea-bed 62.

If for some reason the wellhead 1 does not become disengaged then the shaft 41 is pushed downwards in order to disengage the square shoulder 15 from the engagement arms 3 and allow the spring 50 to pivot the engagement arms 3 to the disengaged position. The shaft 41 is rotated to misalign the keys 28 and the slots 35. The top edge 37 of the key 28 is then prevented from moving up by the lower edge of the main body housing 29 and hence the square shoulder 15 is prevented from moving up and pivoting the engagement arms 3 to the engaged position when the shaft 11 is pulled upwards. This enables the shaft 41 to be pulled upwards without the engagement arms 3 engaging the external profile 4 of the wellhead 1 so that the tool 2 may be recovered from the wellhead when it is not possible to remove the wellhead after the casing has been cut.

The invention has the advantage that it is not necessary to exert a force on the interior of the wellhead 1 and so damage to the interior of the wellhead is avoided by only exerting a force on the outside of the wellhead 1 via the engagement arms 3.

The particular examples described above have been for a "Cameron" type wellhead. However, by suitable adjustment of the engagement sections of the engagement arms 3, the device could be modified to engage the external profile of any wellhead. Also, for wellheads which have a smaller outside diameter spacing shims could be inserted on the inside of the skirt 5 to prevent movement of the tool 2 when it is engaged with a wellhead of a smaller outside diameter.

Generally, the three engagement arms 3 are situated at 120 degree intervals around the circumference of the tool 2 and this gives optimum distribution of pulling forces between the wellhead 1 and each engagement arm 3.

Although the apparatus described above incorporates a cutting tool, the apparatus could be used without the cutting mechanism as a simple wellhead latch device.

Modifications and improvements may be incorporated without departing from the scope of the invention.

I claim:

1. An apparatus for recovering a wellhead, comprising:

a housing;

a latch device mounted on the housing for movement between engaged and disengaged positions relative to said wellhead; and a latch device actuator movably coupled to the housing to actuate said latch device and to move said latch device between said engaged and disengaged positions, the apparatus configured that when a force is applied to said apparatus to separate said apparatus from the wellhead, said latch device actuator moves to actuate said latch device to engage an external profile of the wellhead so that said apparatus remains in engagement with the wellhead.

2. Apparatus according to claim 1, wherein the latch device comprises an engagement arm (3) which is movable between a disengaged position and an engage position.

3. Apparatus according to claim 2, wherein the engagement arm (3) is pivotable between an engaged position in which the engagement arm (3) engages the external profile (4) of the well-head (1) and a disengaged position in which the engagement arm (3) is disengaged from the wellhead (1).

4. Apparatus according to claim 2 or claim 3, wherein the latch device further comprises biassing means (50) which biasses the engagement arm (3) to the disengaged position.

5. Apparatus according to any of claims 2 or 3, wherein the actuator comprises a surface (15) which co-operates with the engagement arm (3) when actuated to pivot the arm (3) to the engaged position, against the action of the biassing means (50).

6. Apparatus according to claim 5, wherein the surface is a square shoulder (15).

7. Apparatus according to any one of claims 1–3 the apparatus further comprising a disengagement device (8, 9; 28, 35) to prevent actuation of the actuator (15) when the force is applied to the apparatus in order to enable the apparatus to be removed from the wellhead (1).

8. Apparatus according to any one of claims 1–3 the apparatus further comprising a shaft (11; 68) which extends through the housing and which is rotatable relative to the housing.

9. Apparatus according to claim 8, wherein a cutting mechanism (60) is adapted to be attached to the shaft (11; 68).

* * * * *

UNITED STATES PATENT AND TRADEMARK OFFICE

CERTIFICATE OF CORRECTION

PATENT NO. : 5,146,989

DATED : September 15, 1992

INVENTOR(S) : Geoffrey O. Rouse

It is certified that error appears in the above-indentified patent and that said Letters Patent is hereby corrected as shown below:

In column 1, line 11, "in&o" should read --into--.

In column 3, line 55, "disengages" should read --disengaged--.

Signed and Sealed this

Ninth Day of November, 1993

Bruce Lehman

*Attest:*

BRUCE LEHMAN

*Attesting Officer*

*Commissioner of Patents and Trademarks*